US008395552B2

(12) United States Patent
Geiler et al.

(10) Patent No.: US 8,395,552 B2
(45) Date of Patent: Mar. 12, 2013

(54) ANTENNA MODULE HAVING REDUCED SIZE, HIGH GAIN, AND INCREASED POWER EFFICIENCY

(75) Inventors: Anton L. Geiler, Chestnut Hill, MA (US); Carmine Vittoria, Charlestown, MA (US); Vincent G. Harris, Sharon, MA (US)

(73) Assignees: Metamagnetics, Inc., Canton, MA (US); Northeastern University, Boston, MA (US)

( * ) Notice: Subject to any disclaimer, the term of this patent is extended or adjusted under 35 U.S.C. 154(b) by 0 days.

(21) Appl. No.: 13/301,377

(22) Filed: Nov. 21, 2011

(65) Prior Publication Data

US 2012/0154234 A1 Jun. 21, 2012

Related U.S. Application Data

(60) Provisional application No. 61/416,679, filed on Nov. 23, 2010.

(51) Int. Cl.
*H01Q 1/24* (2006.01)

(52) U.S. Cl. ..... 343/700 MS; 343/767; 343/787

(58) Field of Classification Search ..... 343/700 MS, 343/767, 770, 787
See application file for complete search history.

(56) References Cited

U.S. PATENT DOCUMENTS 5,905,472 A * 5/1999 Wolfson et al. ..... 343/772
5,955,998 A * 9/1999 Roberts et al. ..... 343/768
6,071,957 A 6/2000 Miller et al.
6,482,861 B2 11/2002 Miller et al.
6,492,554 B2 12/2002 Dalton et al.
6,569,896 B2 5/2003 Dalton et al.
6,772,147 B2 8/2004 Wang
6,842,140 B2 * 1/2005 Killen et al. ..... 343/700 MS
7,041,844 B2 5/2006 Miller et al.
7,129,377 B2 10/2006 Miller et al.
7,205,437 B2 4/2007 Dalton et al.
7,253,210 B2 8/2007 Dalton et al.
7,592,957 B2 9/2009 Achour et al.
7,847,739 B2 12/2010 Achour et al.
7,855,696 B2 12/2010 Gummalla et al.
7,919,647 B2 4/2011 Dalton et al.
2001/0012839 A1 8/2001 Dalton et al.
2002/0099036 A1 7/2002 Dalton et al.
2002/0099096 A1 7/2002 Dalton et al.
2002/0173495 A1 11/2002 Dalton et al.
2003/0022868 A1 1/2003 Dalton et al.
2003/0162761 A1 8/2003 Steiner et al.
2003/0163443 A1 8/2003 Wang (Continued)

OTHER PUBLICATIONS

International Search Report for International Application No. PCT/US2011/061691, mailed Mar. 12, 2012.

*Primary Examiner* — Tho G Phan
(74) *Attorney, Agent, or Firm* — Lisa M. Treannie, Esq.; Sean D. Detweiler, Esq.; Morse, Barnes-Brown & Pendleton, P.C.

(57) ABSTRACT

A broadband integrated circulator antenna (BICA) module for receiving and transmitting signals with high efficiency and high gain. The BICA can have a bandwidth of over 70% of a radar band and can operate in frequencies from UHF to S-band and above. The BICA has a stack configuration that includes a low profile antenna, a reflecting layer or a metamaterial substrate layer, and a circulator. The circulator is placed proximal to antenna, which greatly reduces the size of the BICA. The circulator can be a stripline Y-junction ferrite circulator and the antenna can be a coaxial center fed bow-tie antenna. The reflecting layer or metamaterial substrate layer can comprise electronic bandgap metamaterial and a high permeability ferrite substrate. The high permeability ferrite substrate can be cobalt substituted Z-type barium hexaferrite.

10 Claims, 11 Drawing Sheets

U.S. PATENT DOCUMENTS

2003/0225040 A1 12/2003 Dalton et al.
2003/0232792 A1 12/2003 Dalton et al.
2003/0232882 A1 12/2003 Miller et al.
2004/0014975 A1 1/2004 Dalton et al.
2004/0029913 A1 2/2004 Dalton et al.
2004/0087557 A1 5/2004 Steiner et al.
2004/0138244 A1 7/2004 Dalton et al.
2004/0147550 A1 7/2004 Dalton et al.
2004/0189527 A1* 9/2004 Killen et al. ..... 343/700 MS
2004/0197928 A1 10/2004 Dalton et al.
2004/0248862 A1 12/2004 Miller et al.
2004/0260108 A1 12/2004 Dalton et al.
2004/0265916 A1 12/2004 Dalton et al.
2005/0033074 A1 2/2005 Dalton et al.
2005/0038110 A1 2/2005 Steiner et al.
2005/0163835 A1 7/2005 Gellert et al.
2005/0209229 A1 9/2005 Gilday et al.
2006/0004042 A1 1/2006 Dalton et al.
2006/0009529 A1 1/2006 Dalton et al.
2006/0019931 A1 1/2006 Dalton et al.
2006/0035965 A1 2/2006 Dalton et al.
2006/0111441 A1 5/2006 Dalton et al.
2006/0183931 A1 8/2006 Dalton et al.
2006/0229362 A1 10/2006 Dalton et al.
2007/0285324 A1* 12/2007 Waterhouse et al. ..... 343/718
2008/0048917 A1 2/2008 Achour et al.
2008/0258993 A1 10/2008 Gummalla et al.
2009/0219213 A1 9/2009 Lee et al.
2009/0295660 A1 12/2009 Xu et al.
2009/0322637 A1* 12/2009 Livingston et al. ..... 343/770
2010/0117908 A2 5/2010 Lee et al.
2011/0026624 A1 2/2011 Gummalla et al.

* cited by examiner

118

120

ANTENNA MODULE HAVING REDUCED SIZE, HIGH GAIN, AND INCREASED POWER EFFICIENCY

RELATED APPLICATIONS

This application claims priority to, and the benefit of, U.S. Provisional Application No. 61/416,679, filed Nov. 23, 2010, for all subject matter common to both applications. The disclosure of said provisional application is hereby incorporated by reference in its entirety.

FIELD OF THE INVENTION

The present invention relates to antenna devices suitable for wireless and satellite communication as well as radar applications. More particularly, the present invention relates to integrated antenna and circulator modules arranged in a stack configuration and having improved properties such as ultra wide bandwidth, increased power efficiency, decreased signal distortion, reduced size, and reduced weight, among others.

BACKGROUND OF THE INVENTION

Antenna technology has been developed for the transmission and reception of electronic signals in a wide range of devices, including radar and communications devices. Depending on the particular device and its functional purposes, signals may be data, audio, visual, or other types of signals. Many devices that utilize antenna technology involve interaction with additional electronic components. Since these components are frequently packaged together with the antenna to form a single device, the size and weight of the antenna module has important implications for the interior design and the manufacturing process of such devices. This is especially true for airborne and space applications, where platforms are constrained by having limited surface areas for antenna mounting. Given that smaller models are generally more convenient to use, more marketable, and can be less expensive to build, small antenna modules with high gain, high power efficiency, and wide bandwidth are extremely desirable within a large number of technological fields.

It is especially desirable to provide an antenna that is electrically small. 'Electrically small' is herein defined to accord with conventional definitions. That is, an electrically small antenna is an antenna with a total height of less than one quarter of a wavelength at its center frequency.

Broadband antennas having low profile designs can offer certain advantages, including being smaller, lighter weight, and easier to manufacture. Low profile broadband antennas generally consist of one or more radiating apertures located within a single transverse plane and arranged in a particular configuration. Some common examples include patch antennas, bow-tie antennas, dipole antennas, slot antennas, and spiral antennas. These antennas can be backed by a cavity and a ground plane to improve directivity and impedance match. All systems can benefit from smaller, lighter antennas. Consumer demands continue to place further size and weight requirements on antenna modules.

Existing antennas do not meet the technological needs for numerous commercial and military applications such as weather radar, Earth science radar, automotive radar, wireless communications, radio frequency identification, military security, surveillance and communication, and others. The need for improved antennas has become especially demanding in airborne and space applications where large or heavy antennas can greatly impede desired functionality. This is true for antenna applications in planes, autonomous vehicles, and satellites, among others. However, due to physical restrictions on the existing technology, most antennas are limited in their minimum occupied space without producing additional undesired distortion and interference. One physical constraint is the $\lambda/4$ requirement for cavity-backed antennas. This requirement dictates that the cavity between an antenna and a ground plane must have a height of at least $\lambda/4$ to avoid image fields interference. As a result, size reduction below $\lambda/4$ can generally only be achieved at the expense of gain, bandwidth and efficiency. Many cavity-backed antennas meeting this $\lambda/4$ cavity requirement do not permit radar or communications devices to efficiently utilize interior space. Furthermore, such antennas may be relatively heavy and expensive to produce.

Some suggestion has been made that electrically small antennas made from metamaterials may be possible. Metamaterials are artificial structures that are appealing for the application of antennas because they can be designed to exhibit electromagnetic properties not commonly found in nature. The effective permittivity and permeability of these materials can be tailored to control wave propagation through the metamaterials in desired ways. In all metamaterials, including electromagnetic band gap (EBG) metamaterials, wave propagation is determined by band structure. Metallo-magnetic and metallo-dielectric EBG metamaterials can be made of periodically-spaced metallic scatterers embedded in otherwise RF-transparent magnetic and dielectric materials. The periodic structure produces forbidden frequency bands in which electromagnetic waves of certain frequencies cannot pass. Additionally, the EBG surface approximates a perfect magnetic conductor (PMC) surface at which energy is reflected in phase with the incident wave. The usable bandwidth of the EBG when operating as a PMC is considered to be the frequency range over which the phase of the reflection coefficient is bounded by ±45°.

Given their reflecting properties as a PMC, metallo-dielectric EBG materials are well-suited for realizing electrically small yet efficient antenna designs. However, at least one obstacle to using EBG metamaterials for broadband antenna applications is the relatively narrow band gaps of the EBG, which restricts antenna bandwidth to 10% or less. This is due to the resonant nature of capacitive patches. Furthermore, EBG metamaterials are typically anchored by inductive vias, which can impose additional limitations on bandwidth in some applications.

SUMMARY

There is a need for a broadband antenna having reduced size and weight, enhanced power efficiency, and ultrawide bandwidth. The present invention is directed toward further solutions to address this need, in addition to having other desirable characteristics.

In accordance with one aspect of the present invention, an antenna module has a first layer having a coaxial center fed bow-tie antenna fabricated on a metamaterial. A second layer has a junction circulator, the junction circulator positioned in such a way so as to be proximal to the antenna. The combination of the low profile antenna and junction circulator can form a broadband integrated circulator antenna (BICA) as a single component.

In accordance with further aspects of the present invention, the antenna can be a coaxial center fed bow-tie antenna, an Archimedean spiral antenna, a square slot spiral antenna, or another antenna. The metamaterial can be composed of a broadband electronic bandgap (EBG) metamaterial, a dielectric substrate, or a magnetic substrate. The metamaterial can further be embedded in a high permeability ferrite substrate, which can be cobalt substituted Z-type barium hexaferrite (CoZ ferrite). The ferrite substrate can have a frequency range of about 10 MHz up to about 4 GHz. Furthermore, the input impedances of the circulator and the antenna can match and can be configured to optimize bandwidth at operational frequencies. The antenna can further include a balun structure connected to the circulator and the antenna, and the balun structure can be configured to provide balanced feed to the antenna and to prevent radiation pattern distortion.

According to one aspect of the present invention, an antenna module has a first layer having a low profile antenna formed by at least one radiating aperture. A second layer has a ferrite circulator that can be positioned in such a way as to be distanced no more than $\lambda/10$ away from the antenna. A third layer of reflecting material is positioned between the first layer and the second layer, and it can be configured to reflect energy in phase with incident waves. The combination of the low profile antenna, junction circulator, and balun structure can form a broadband integrated circulator antenna (BICA) as a single component.

According to yet further aspects of the invention, the ferrite circulator can be a ferrite stripline circulator. The reflecting material can be an EBG metamaterial and can be embedded in a high permeability ferrite substrate. The ferrite substrate can be CoZ ferrite, which can have a frequency range of about 10 MHz up to about 4 GHz. Furthermore, the input impedances of the circulator and the antenna can match and can be configured to optimize bandwidth at operational frequencies. The antenna module can also include a balun structure connected to the circulator and the antenna, which can be configured to provide balanced feed to the antenna and to prevent radiation pattern distortion.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
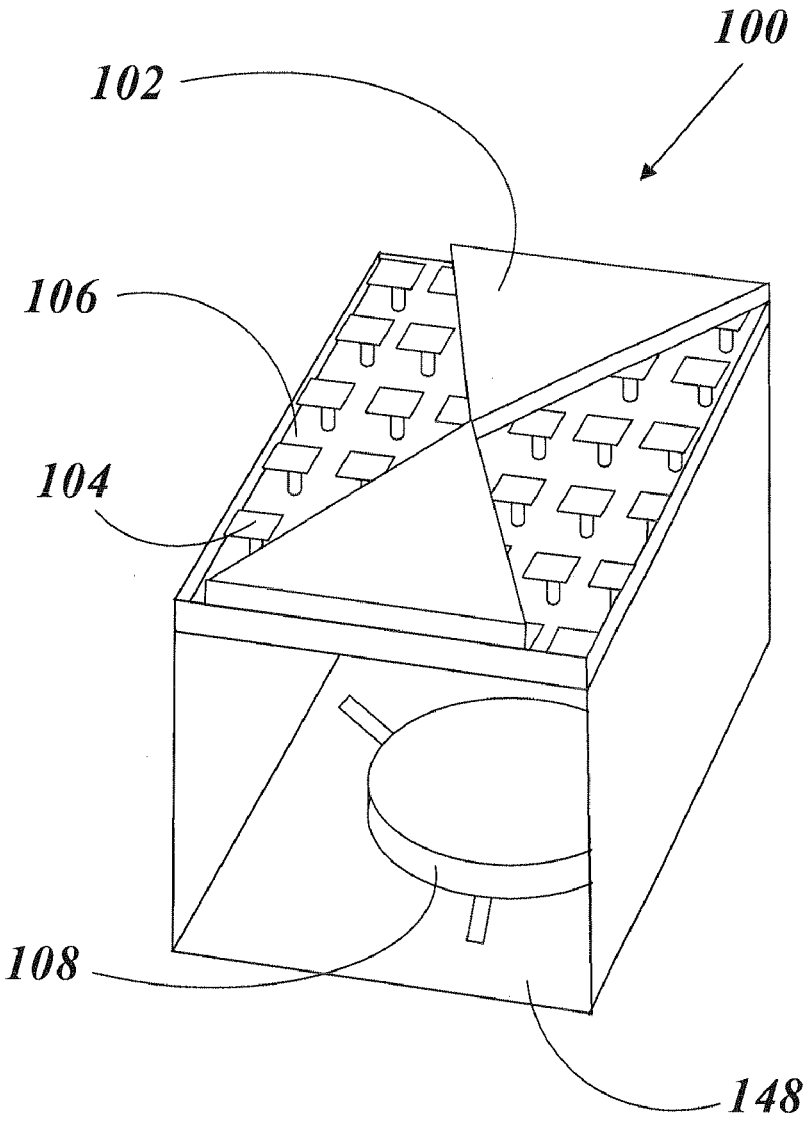
FIG. 1 illustrates a three-dimensional view of an assembled antenna module having a stacked configuration according to one embodiment of the present invention.

An illustrative embodiment of the present invention relates to a low-profile antenna module designed for more efficient power transfer, increased bandwidth, decreased distortion, and reduced size. To achieve this combination of properties, as well as others, the illustrative embodiment described herein implements a novel stack configuration. In the illustrative embodiment, the stack configuration comprises various component layers that are positioned substantially parallel to each other. Specifically, the layers of the stack configuration include components such as a stripline ferrite circulator, a coaxial center fed bow-tie antenna, EBG metamaterial embedded in a layer of ferrite substrate having high permeability in the frequency range from 10 MHz to about 4 GHz, and a ground plane. The stack configuration of the illustrative embodiment eliminates traditional size constraints including the $\lambda/4$ cavity requirement due to the phase inversion caused by metal reflecting surfaces. In the illustrative embodiment the cavity between then ground plane and the $\lambda/20$ and the total package height is $\lambda/15$. In other embodiments the cavity can be as small as $\lambda/100$.

Stack configurations of substantially parallel component layers have heretofore not been employed for a number of reasons. Distances of $\lambda/4$ or smaller between an antenna and circulator have previously been impossible for broadband antennas characterized by high gain and high efficiency. Furthermore, stack configurations are generally viewed as impractical because of the minimum required thickness associated with cavity-backed antennas. Given the various limitations on the prior art, it is not surprising that most existing attempts in the art produce smaller antennas at the expense of device performance. The illustrative embodiment, on the other hand, succeeds in providing an improved antenna with smaller cavity heights by implementing metamaterials embedded in high permeability ferrite substrates. These smaller cavity heights make possible an entirely new type of configuration wherein the circulator, antenna, and cavity are all stacked on top of each other in component layers. As such, the illustrative embodiment distinguishes over prior art antennas at least by providing an integrated module wherein the circulator and antenna can be proximally placed on top of each other to function as a single integrated component.

A 'low profile' antenna is generally understood to be an antenna having a height that is significantly smaller than one quarter of a wavelength at its center frequency. This definition is used herein when making reference to 'low profile' antennas. While the illustrative embodiment utilizes a low-profile antenna, one or ordinary skill in the art will appreciate that different embodiments can implement other types of antennas in order to meet the performance needs of other applications. As such, the particular selections and characteristics of the embodiments described herein are merely for purposes of illustration and are not limiting to the scope of the invention.

In many instances the word 'proximal' or 'proximally' is referred to, especially in regards to the placement of certain components of an antenna module. 'Proximal' and its variations are accordingly defined herein to have a specific definition that relates to a particular distance having special significance in the field of the invention. When a first component of device that operates at a center frequency is 'proximally' placed by a second component of that device, the two components are herein defined as being situated such that the distance between them is less than one quarter of a wavelength, when at the center frequency. Thus, according to this definition, a cavity-backed antenna that is proximally placed by a ground plane qualifies as an electrically small antenna since the distance between the ground plane and the antenna is less than λ/4.

FIGS. 1 through 4 and 6 through 8B, wherein like parts are designated by like reference numerals throughout, illustrate example embodiments of a low-profile antenna module designed to have increased power efficiency, ultra-wide bandwidth, decreased distortion, high gain, and reduced size according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

Figure 2A:
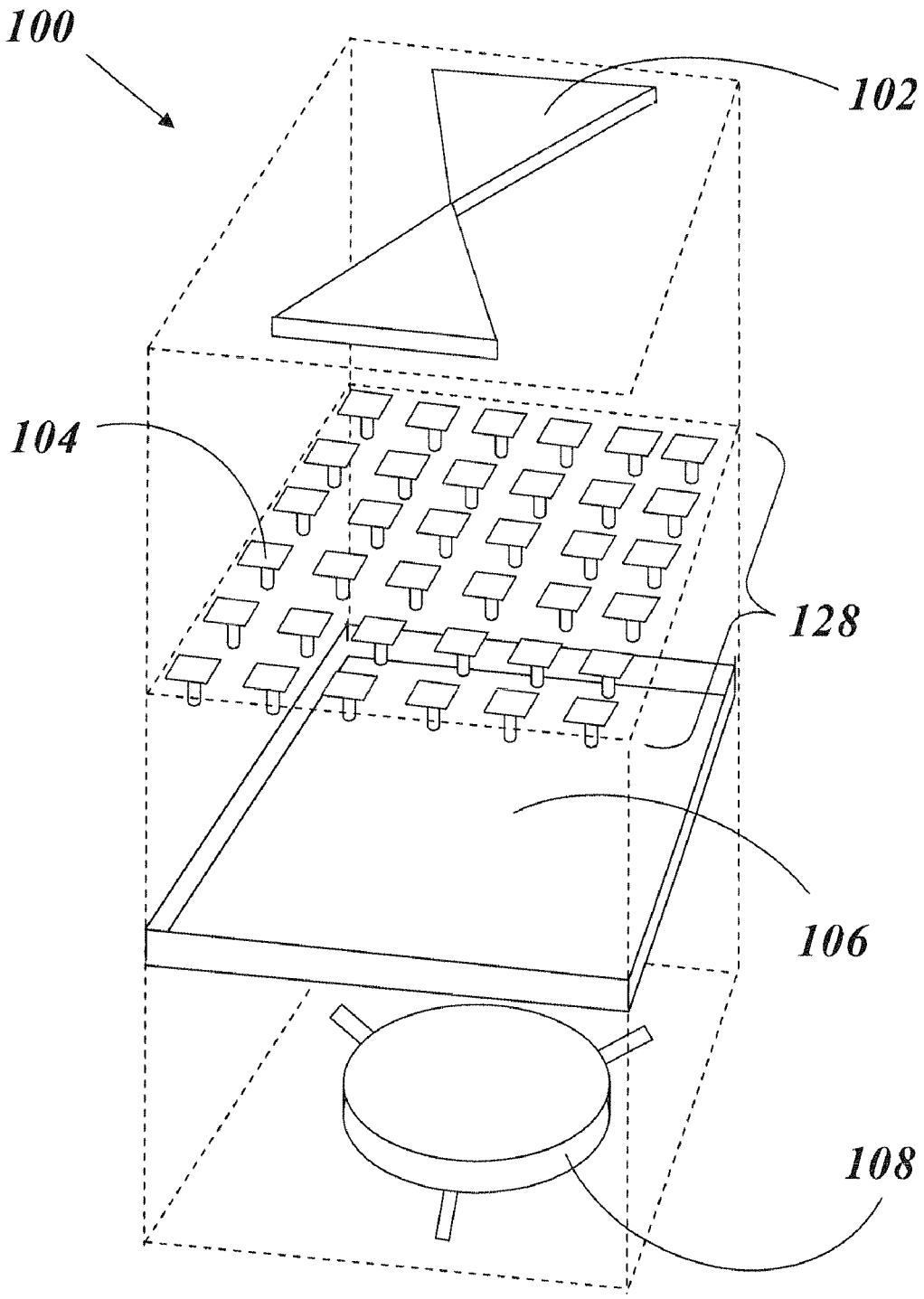
FIGS. 2A and 2B illustrate a three-dimensional view of the inner architecture and the separate layers of an antenna module having a stacked configuration according to one embodiment of the present invention.
Figure 2B:
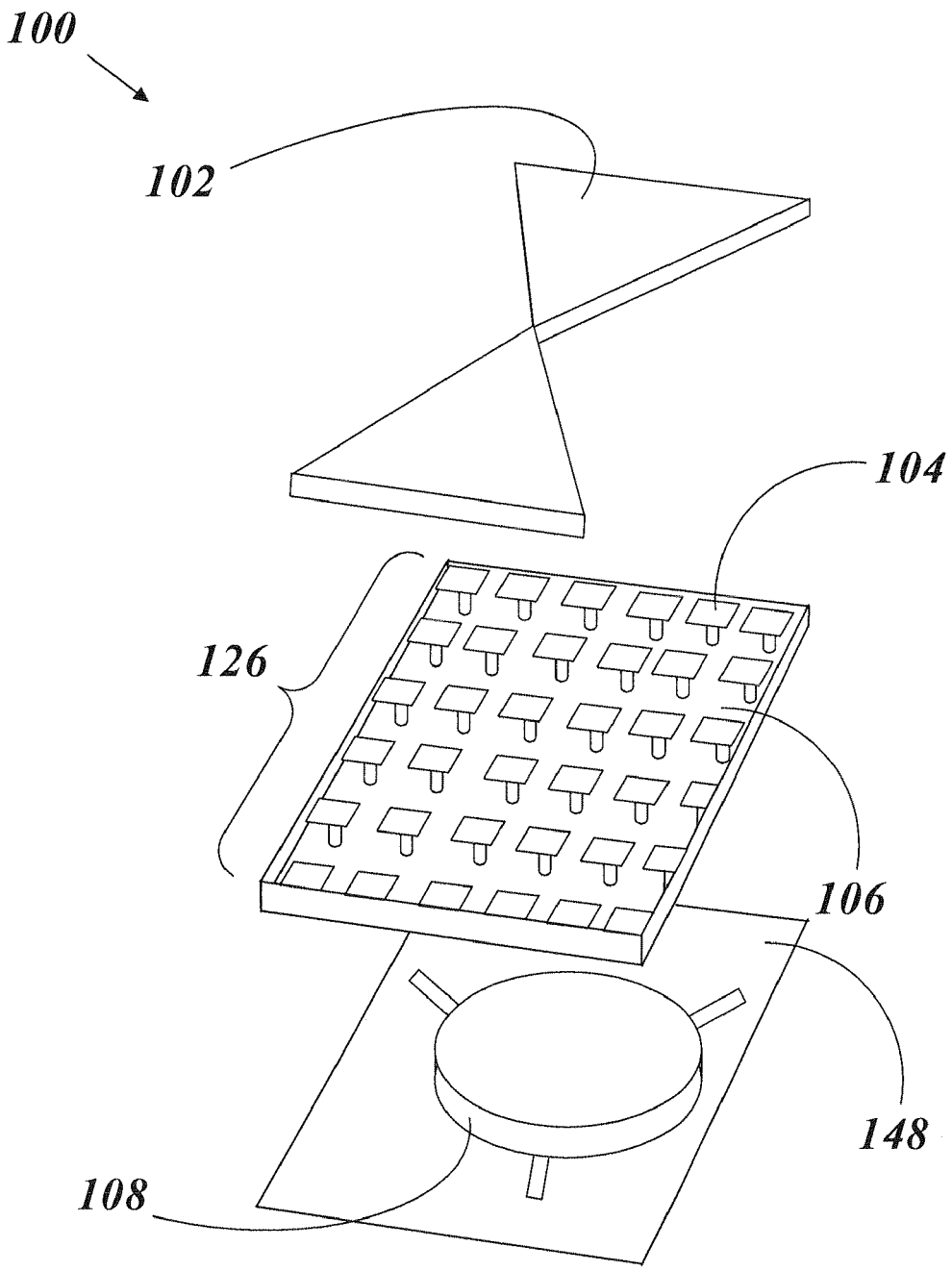

FIG. 1 illustrates a novel antenna module in a stack configuration according to one embodiment of the present invention. The figure shows various layers containing components of the antenna module. As depicted in the drawing, the layers are positioned and oriented substantially parallel to each other. FIG. 2A and FIG. 2B provide exploded views that better illustrate the interior components and the separate layers of the stack configuration. On the top layer of the stack configuration is a low-profile antenna 102, which can be a coaxial center fed bow-tie antenna. Positioned below and adjacent to the bow-tie antenna is an EBG substrate layer 126. In the illustrative embodiment, the antenna 102 sits directly on top of the EBG substrate layer 126. Within the EBG substrate layer 126 is EBG metamaterial 128 embedded in a high-permeability ferrite substrate 106. In the illustrative embodiment, the ferrite substrate 106 is cobalt substituted Z-type barium hexaferrite. Below the EBG substrate layer 126 is a circulator 108 in the form of a stripline Y-junction ferrite circulator. The circulator 108 is positioned proximal to the antenna 102. In an exemplary embodiment, the stripline circulator is only λ/20 away from the antenna 102. These various layers including the antenna 102, the EBG substrate layer 126, and the circulator 108 can be housed together in a standalone rf package or in the front end of a transmit/receive module to form a single broadband integrated circulator antenna (BICA) 100 as a single component.

Figure 3A:
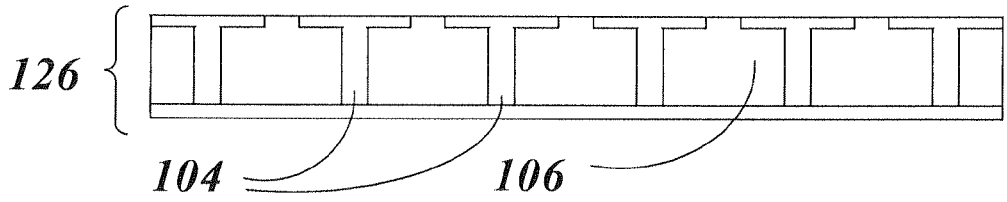
FIGS. 3A and 3B illustrate side and top views, respectively, of EBG metamaterial embedded in a high-permeability ferrite substrate according to one aspect of the present invention.
Figure 3B:
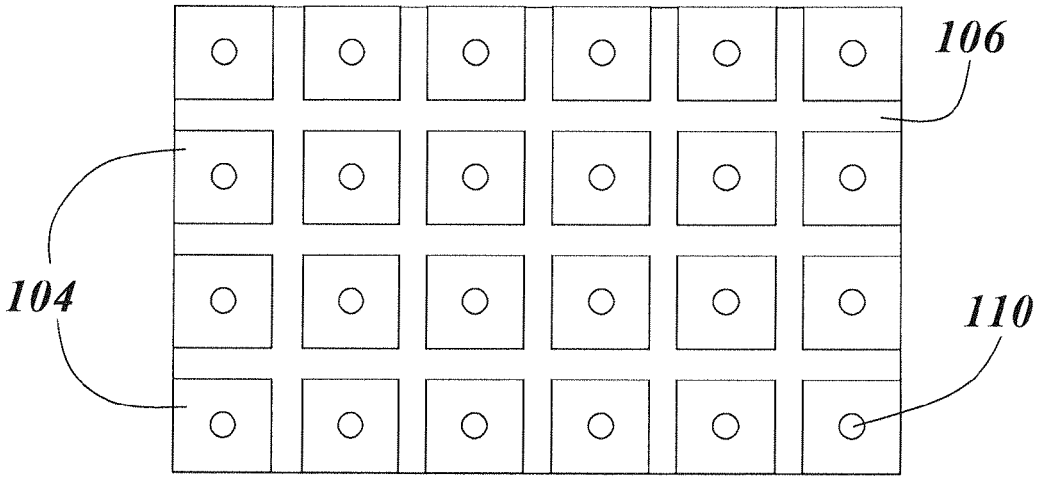

FIG. 3A is a side view of the EBG substrate layer 126 and FIG. 3B is a top view of the EBG substrate layer 126. The EBG metamaterial 128 comprises periodically-spaced metallic scatterers 104 embedded in a ferrite substrate 106. The metallic scatterers create forbidden frequency bands that can be configured to prevent specific frequencies, such as the frequencies of standing waves or the frequencies associated with other types of distortion, from passing through the EBG metamaterial 128. The ferrite substrate 106 is transparent to RF waves and allows desired frequencies to pass. In this illustrative embodiment, the EBG metamaterial is embedded directly in or laid directly on top of the ferrite substrate. In the illustrative embodiment, metallic vias 110 connect the metallic scatterers 104 to a ground plane 148. The ground plane 148 can be made of copper, brass, gold, steel, or another material that is highly conductive and suitable for use as an electric shield. The EBG substrate layer 126 can sit directly on a ground plane 148.

The vias 110 connect the metallic scatterers to the ground plane 148 and provide the necessary inductive loading of the substrate. However, one of ordinary skill in the art will appreciate that, depending on the particular application of the BICA 100, metallic vias 110 may not necessarily improve performance of the device and therefore may not be desirable. As such, other embodiments of the present invention can eliminate the need for metallic scatterers 110 through inductive loading of the ferrite substrate. These embodiments provide an integrated antenna and circulator module that does not include any metallic vias 110. Excluding the metallic vias 110 has advantages associated with manufacturing. For example, the EBG metamaterial fabrication process can be greatly simplified when metallic scatterers 110 are not included in their production. Additionally, eliminating metallic scatterers can significantly reduce manufacturing costs.

One of ordinary skill in the art will appreciate that one or more external magnetic fields may be needed to achieve high permeability in the ferrite substrate in the frequency range from 1 to 4 GHz. In some embodiments, this field is provided by permanent magnets (not shown) that are positioned at the edges of the ferrite substrate. The type and strength of the magnets depends on the applications, the degree of permeability that is desired, and the like. Typical magnets that are known in the art can serve as suitable permanent magnets.

Figure 4A:
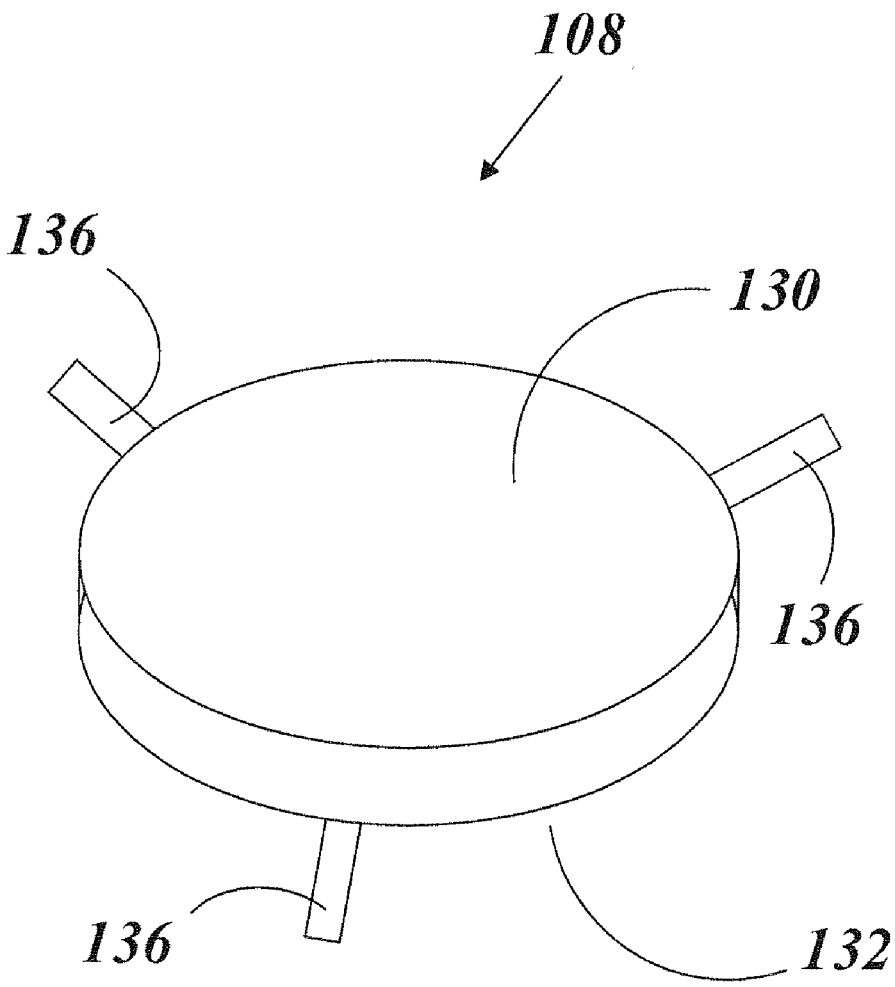
FIGS. 4A, 4B, and 4C are a diagrammatic illustrations of a stripline Y-junction ferrite circulator according to one aspect of the present invention.
Figure 4B:
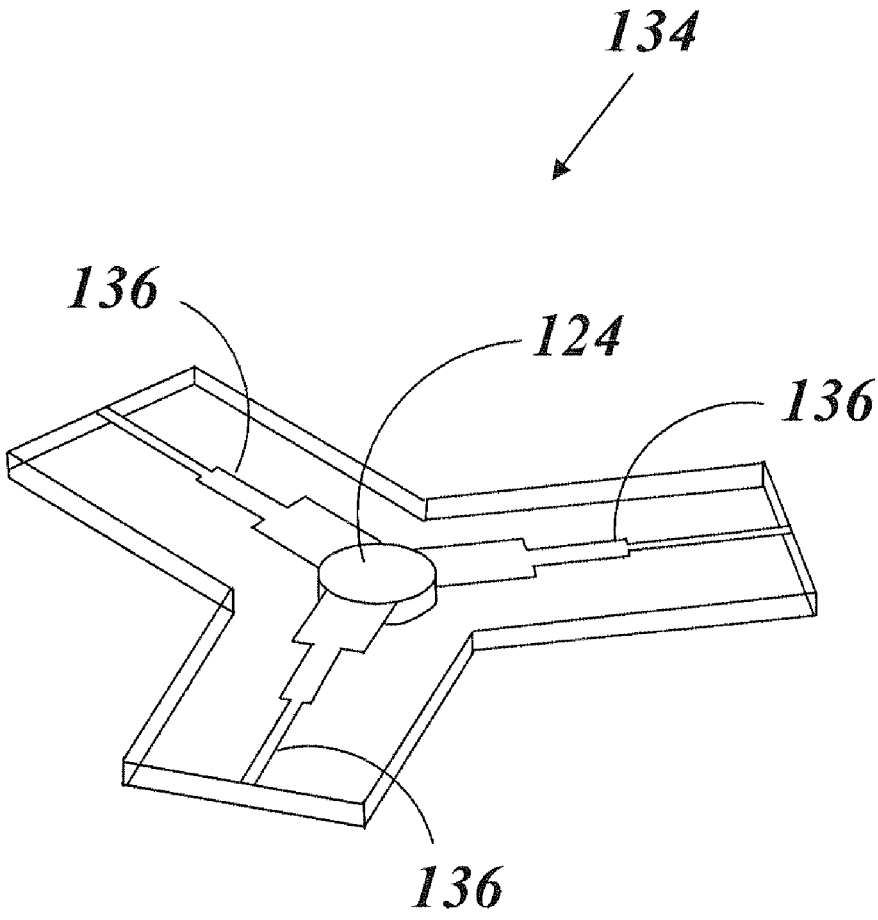

FIG. 4A further illustrates the stripline Y-junction ferrite type of circulator 108. The circulator 108 has three ports 136. Typical ferrite circulators include ferrite and biasing magnets that can create distortion in the radiation pattern when the ferrite circulator is proximal to the antenna. The circulator 108 has a top ground plate 130 and a bottom ground plate 132 that shield electrical signals. FIG. 4B illustrates the circulator 108 without the top and bottom plates. The circulator 108 has a central Y-junction 124 where the three ports 136 meet.

Figure 4C:
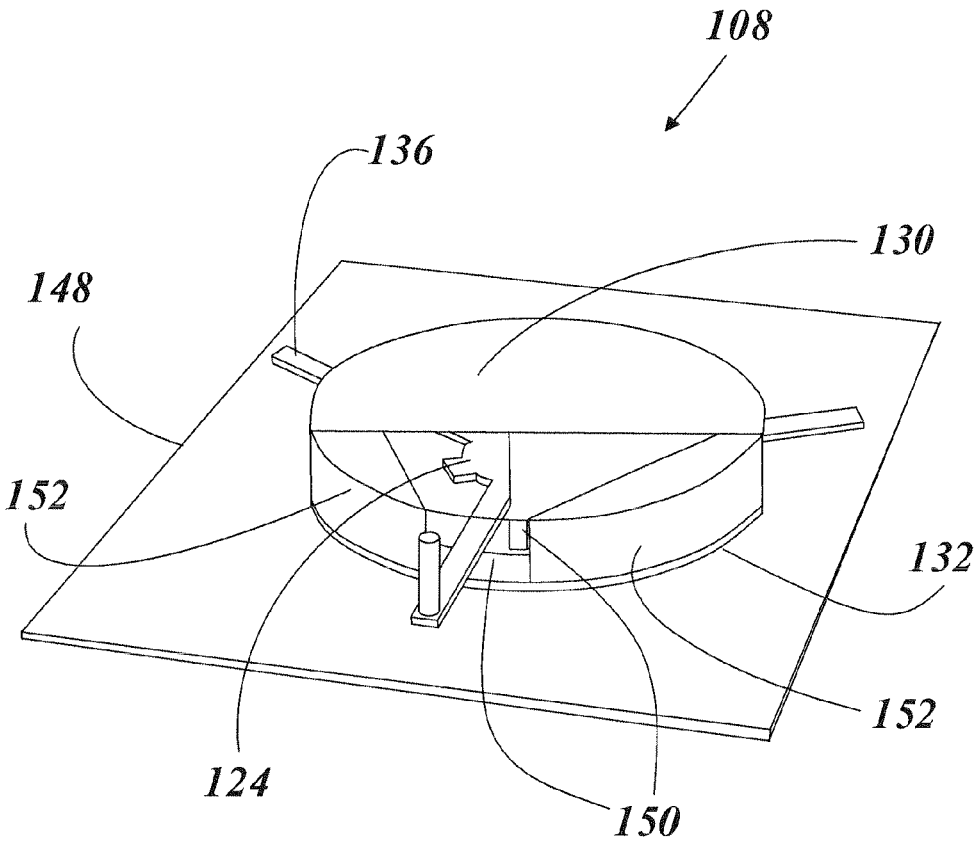

FIG. 4C shows a closer look into the stripline Y-junction ferrite circulator 108. The circulator 108 includes two ferrite pucks 150 made of suitable ferrite material, three permanent biasing magnets 152 (the third biasing magnet is concealed beneath the top plate 130 in the figure), the top plate 130, and the bottom plate 132. Only a back portion of the top plate 130 is shown in order to provide a view of the internal circulator components. The pucks are positioned directly one on top of the other and in parallel with the top and bottom plates. The permanent biasing magnets 152 are positioned substantially vertically along a portion of the outer circumference of the circulator 108. The top and bottom plates 130, 132 can be made of soft magnetic material, such as magnetic steel. The top and bottom plates 130, 132 serve as magnetic flux closures.

Figure 5:
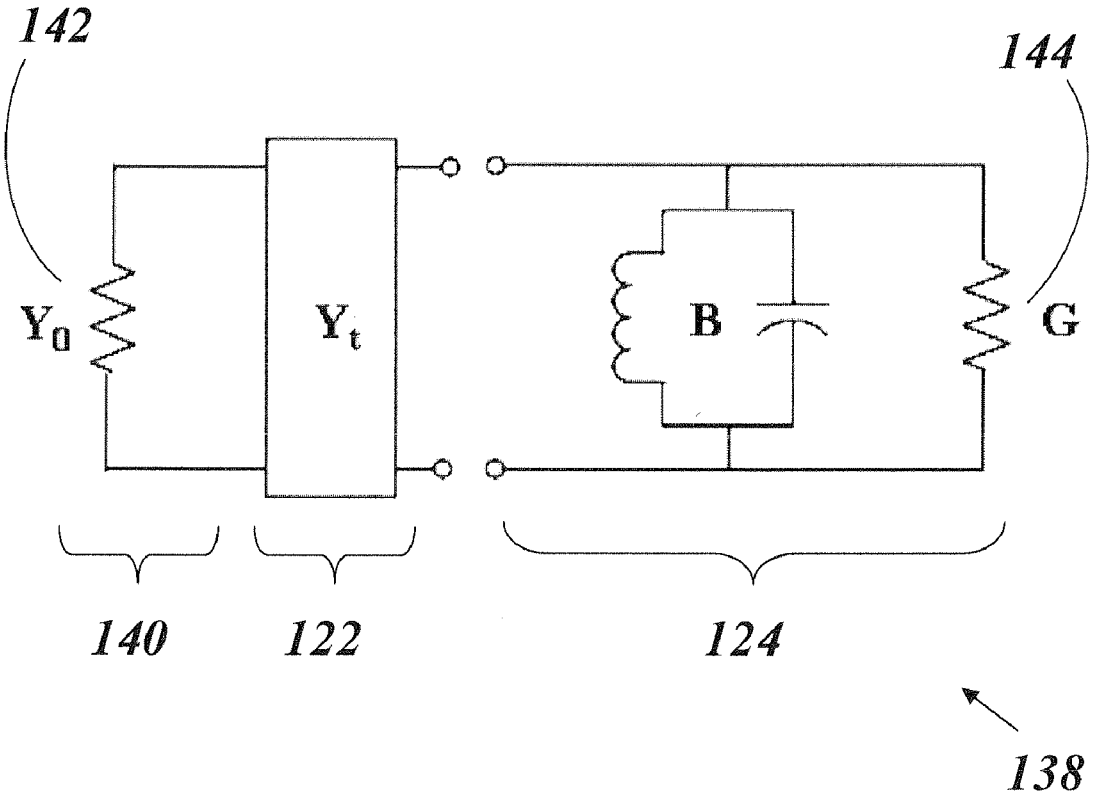
FIG. 5 (Prior Art)
FIG. 5 is a circuit diagram of a conventional impedance matching network for a frequency-independent resistive load.

FIG. 5 is a schematic representation of a conventional circuit 138 for matching input impedances between an antenna and a circulator. The traditional circuit 138 includes a matching network, typically a quarter-wave transformer 122. The quarter-wave transformer 122 is configured to match the input impedance 144 of the Y-junction 124 with the input impedance 142 of the feeder line 140. The input impedance 142 of the feeder line 140 is typically constant for all antenna modules, regardless of the range of frequencies of operation. This imposes a frequency-independent requirement upon the antenna module. Some conventional antennas are built and calibrated such that the input impedance 144 of the Y-junction 124 and the input impedance of the antenna both match the impedance of the feeder line 140 (typically about 50 ohms). However, such a matching network is not sensitive to the range of the operational frequencies, and thus it is over-constrained for modern antenna technology.

Figure 6:
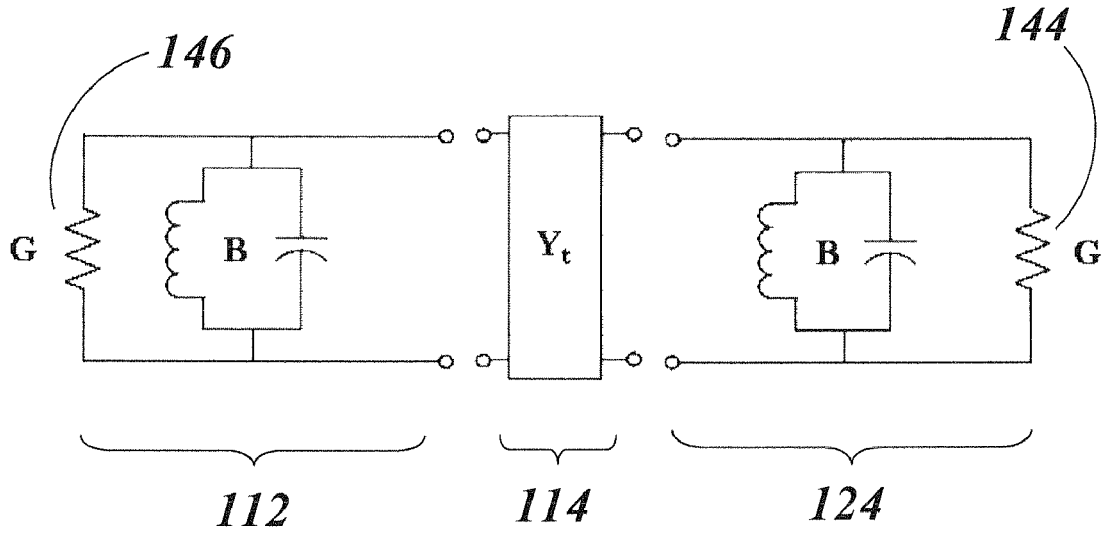
FIG. 6 is a circuit diagram of an impedance matching network comprising a balun structure and an antenna feed point according to one aspect of the present invention.
Figure 7:
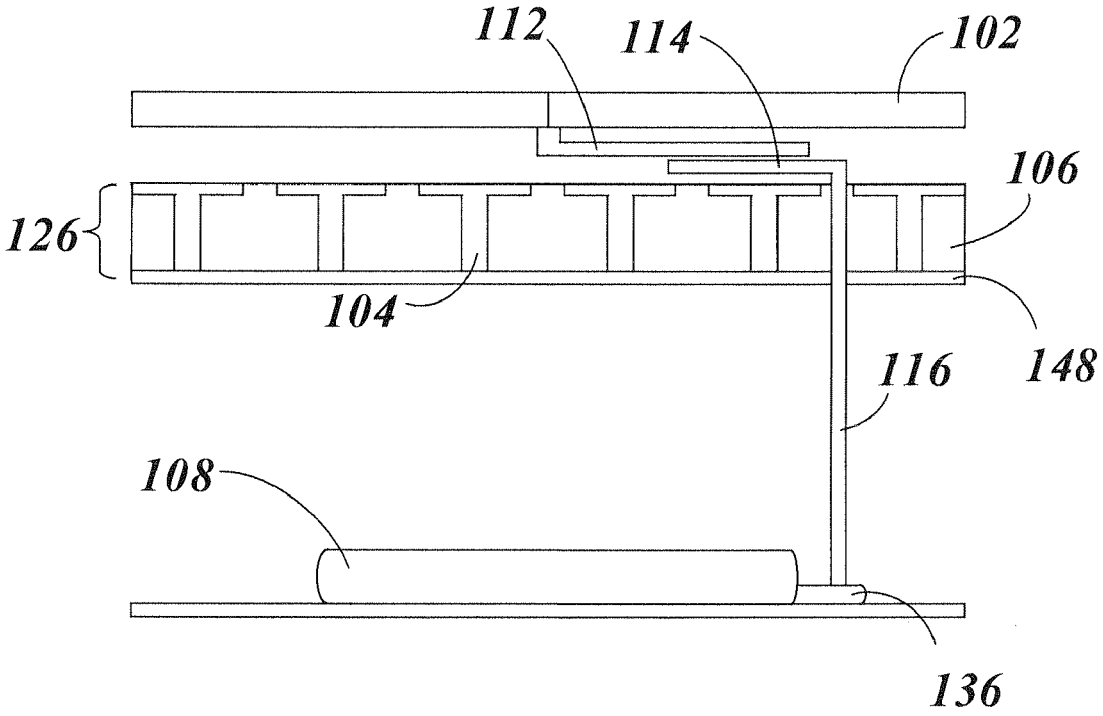
FIG. 7 illustrates a two-dimensional side view of an assembled antenna module having a stacked configuration according to one embodiment of the present invention.

FIGS. 6 and 7 illustrate an impedance matching network for a stack configuration antenna module according to aspects of the present invention. Rather than use a quarter-wave transformer 122, the illustrative embodiment utilizes a transmission type balun transformer 114. As shown in FIG. 6, the balun transformer 114 is electrically connected to the antenna feed point 112 and the Y-junction 124 of the circulator 108.

The antenna 102 has input impedance 146 and the Y-junction 124 has input impedance 144. As FIG. 7 shows, the balun transformer 114 has a transmission line 116 connected to one of the three ports 136 on the circulator 108. The port 136 is connected to the Y-junction 124. The antenna feed point 112 is adjacent to the balun transformer 114 such that they can interact electrically.

The combination of the circulator 108, EBG substrate layer 126, and antenna 102 form the single broadband integrated circulator antenna (BICA) 100, which is structured and also functions as a single component.

Figure 8A:
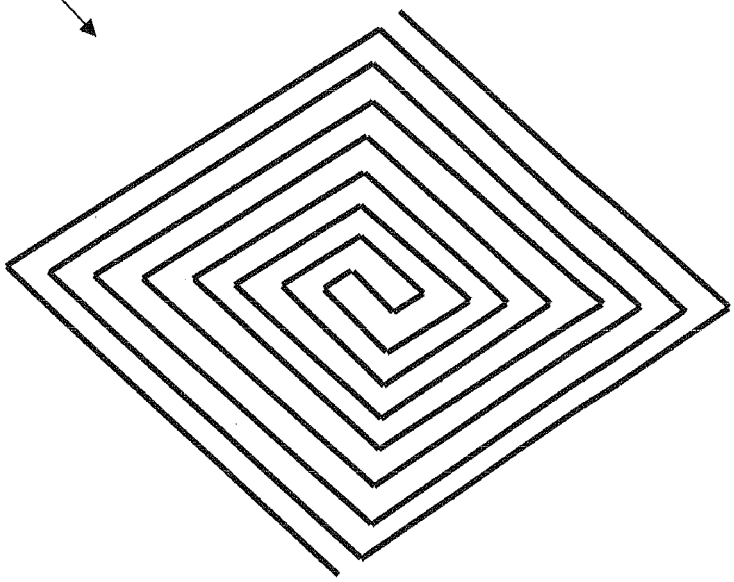
FIGS. 8A and 8B are diagrammatic illustrations of two alternative planar antennas for placement in an antenna module having a stacked configuration according to aspects of the present invention.
Figure 8B:
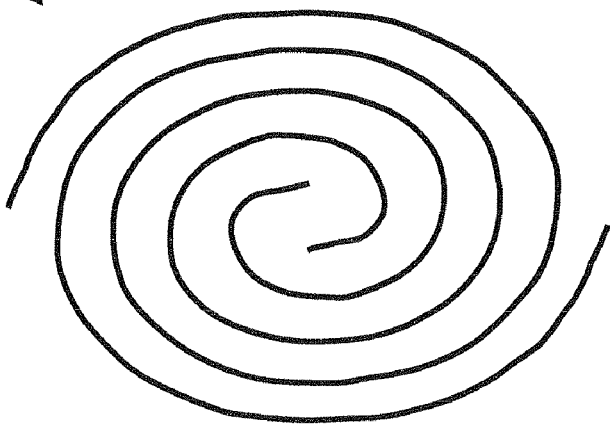

Given the nature of the technological field, there are many possible design substitutes and alterations. The specific design features and performance characteristics described herein are greatly dependent on the particular applications and intended usages. FIGS. 8A and 8B illustrate two low-profile antennas that can be utilized as alternatives to the bow-tie antenna. These include a square slot spiral antenna 118 and an Archimedean spiral antenna 120. One of ordinary skill in the art will appreciate that in addition to these alternatives, any other configuration of one or more radiating apertures situated appropriately can also serve as a suitable low-profile antenna. What is meant by a 'radiating aperture' is one or more pieces of conducting material arranged in any shape and configuration suitable for transmitting and receiving a signal. One of ordinary skill in the art will appreciate that if multiple radiating apertures are to be used, they are configured to operate in cooperation with each other, as a single antenna device. This is because placing two or more antennas side by side can cause interference between the various signals.

The particular choice of low-profile antennas depends on the functional applications and, in some cases, the device in which the antenna will be incorporated. Low profile antennas are particularly attractive in airborne applications due to their small size, low weight, and reduced aerodynamic drag. They also help address placement issues in platforms with limited surface area available for antenna mounting. Some factors to be considered in selecting a particular low profile antenna design include desired radiation polarization (e.g., linear vs. circular), radiation pattern (e.g., unidirectional vs. omni-directional), bandwidth, gain, etc. All of these possible choices, which are known in the art, are contemplated by the present invention.

Similarly, other embodiments of the present invention use different types of metamaterial besides EBG metamaterial, such as metamaterial comprised of dielectric or magnetic substrates. Furthermore, suitable ferrite substrates besides cobalt substituted Z-type barium hexaferrite that possess high permeability and/or low permittivity can be used in the EBG substrate. For alternative embodiments utilizing different metamaterial and high permeability substrates, metallic vias may not be necessary.

One of ordinary skill in the art will appreciate that many other characteristics of the BICA 100 can be tailored to meet a wide variety of applications and uses known in the art, only some of which are mentioned herein. For example, one of the ports of the circulator can be terminated in a matched load such that it functions as an isolator. Greater isolation and return loss can be achieved at the expense of the bandwidth. Similarly, greater bandwidth, gain, and efficiency can be achieved by employing different antenna designs. Linear, elliptical, or circular polarizations can also be obtained with different antenna designs. Even greater profile reduction can be achieved at the expense of gain or bandwidth. Conversely, non-electrically small antennas that utilize a stack configuration can achieve higher gain and wider bandwidth. Such antennas will have a total package height of greater than one quarter of a wavelength but will exhibit improved performance over existing non-electrically small antennas. Furthermore, operation at high frequencies, e.g., C-band and above, can be achieved with a non-magnetic EBG metamaterial design.

While the specific characteristics of the BICA 100 are useful for understanding the illustrative embodiment, one of ordinary skill in the art will appreciate that this working example does not limit the invention to any particular choice of a set of characteristics.

For purposes of explanation, it is assumed that the BICA 100 operates in the S-band. The performance specifications of the BICA 100 at S-band frequencies are presented in Table I. In this table, efficiency includes insertion loss of the circulator and is defined as Efficiency=$P_{TX}/P_{IN}$ or $P_{RX}/P_{OUT}$. Polarization depends on the antenna choice, and can be linear if desired. Furthermore, isolation and return loss can be increased at the expense of bandwidth.

TABLE I

Performance specifications of the BICA 100 assembly at S-band

| Band (GHz) | Bandwidth (%) | Gain (dB) | Efficiency (%) | Isolation (dB) | Return loss (dB) | Power ($W_{ave}/_{pk}$) | Pol. | Dimensions (cm) | Weight (grams) |
|---|---|---|---|---|---|---|---|---|---|
| 2-4 | >70 | ~6 | >70 | ~20 | ~20 | ~50/500 | Circular | <7.5 × 7.5 × 1 | <200 |

The particular band choice for operation of the antenna module can affect many characteristics of the BICA 100, including the dimensions, bandwidth, gain, efficiency, permeability of EBG substrate layer 126, impedance, return loss, isolation, polarization, and the like. Other band choices, operational modes, and characteristics are possible and are contemplated by the invention. Some embodiments operate in higher frequencies, such as the C through W bands, by implementing a stack configuration wherein the circulator 108 is distally placed by the antenna 102. What is meant by 'distal' is that the antenna 102 is located at a distance of one quarter wavelength or farther away from the circulator 108.

In order to understand operation of the illustrative embodiment described herein, as well as improvements in its performance, it is helpful to understand some of the unique characteristics of metamaterials and ferrite substrates. EBG metamaterials have a band structure that exhibits band gap and band pass regions. The region of operation for the illustrative embodiment is the band gap region. Within the band gap region, the EBG metamaterial produces a high-impedance surface that approximates a perfect magnetic conductor (PMC). This has two important implications. One, in the band gap region, the EBG metamaterial reflects waves without introducing a 180 degree phase shift. As such, the ground plane of a cavity-backed antenna need not be positioned a quarter of a wavelength away from the antenna. And two, EBG structure prevents the formation of surface waves within the forbidden frequency bands. It is possible to select which frequencies will be blocked by the EBG metamaterial by altering the permeability, permittivity, or distance of separation between the metallic scatterers 104. Furthermore, it is possible to tune the forbidden bands by applying external magnetic fields to the EBG metamaterial using either coils or permanent magnets. In such embodiments, performance of the low profile antenna module is tunable. This can be advantageous in certain applications requiring very broad operating bandwidths or the ability to tune the center frequency of the antenna.

Eliminating the λ/4 cavity requirement enables use of a much thinner substrate layer and allows the circulator 108 to be placed proximally to the antenna 102. The BICA 100 achieves a total package size of only 7.5 cm×7.5 cm×1 cm at S-band. These dimensions are due to the proximal placement of the circulator 108 near the antenna 102, which is made possible by the reflecting properties of the EBG substrate layer 126. Since the EBG substrate layer 126 reflects energy in phase with incident waves, the cavity of the BICA 100, and hence the height of the EBG substrate layer 126, can be less than one quarter of a wavelength at the center frequency. The stack arrangement provides a cavity-backed antenna wherein the cavity includes EBG metamaterial 128 that approximates a PMC. The EBG substrate layer 126 sits directly on the ground plane 148. The BICA 100 achieves a cavity height of λ/20 or smaller without producing the image fields interference normally associated with cavity heights smaller than λ/4. In other embodiments where even smaller heights are necessary, different magnetic EBG metamaterial designs can be utilized that allow placement of the circulator as close as λ/100 away from the antenna module. In such embodiments, using EBG metamaterials allows more aggressive profile height reduction at the expense of somewhat reduced antenna performance (e.g. gain, efficiency, etc.).

Additional distortion can be caused by the circulator 108, as well as other types of circulators. Many such circulators contain components like ferrite magnets or biasing magnets that can cause interference in the radiation pattern when placed proximally to the antenna 102. To mitigate or altogether avoid such interference, the BICA 100 includes a top ground plate 130 and a bottom ground plate 132 positioned on the circulator 108 that can electrically shield the antenna 102 from possible distorting effects of the circulator 108. The top and bottom plates 130, 132 serve as magnetic flux closure paths. The biasing flux from the permanent biasing magnets 152 permeates the ferrite pucks 150 uniformly and does not leak out and interfere with other components of the BICA 100. Without the shields 130, 132, placing the circulator 108 a twentieth of a wavelength below the antenna 102 could cause distortion.

For the BICA 100, the resulting total package height is λ/15 or smaller. The footprint of the BICA 100 is dictated by the size of the circulator and the antenna. Typically, these components limit the width and height of planar antennas to values of λ/2×λ/20. For the BICA 100, which is built for operation in the S-band and uses a coaxial center fed bow-tie type of antenna 102 and a stripline Y-junction ferrite type of circulator 108, the dimensions are 7.5 cm×7.5 cm×1 cm.

Other beneficial characteristics of the illustrative embodiment can be attributed to the textured ferrite materials. Textured ferrite materials have relatively high permeability values in the range of 10 to 100 and relatively low permittivity values in the range of 12 to 22. For operation in the UHF, L-, or S-bands, highly anisotropic ferrite materials are useful. In general, permeability of a ferrite material tends to drop off at higher frequencies. For ferrite materials with higher permittivity, the operational bandwidth (i.e., the range of frequencies for which permeability of the ferrite material is high) tends to below with a relatively low cutoff frequency. However, ferrite materials can be manipulated during the fabrication process to compensate for these limitations. One well-known technique is to apply a magnetic field during the fabrication process to magnetically orient, or texture, the material in order to produce a ferrite material with higher permeability values at wider frequency ranges. Further, magnetic bias fields can be applied to the fabricated ferrite material to further increase the operating frequency range. Through proper manipulation, ferrite materials can also act as high permeability substrates at lower frequencies (<1 GHz). This is done by selecting particular ferrite materials and manufacturing them in ways that art known in the art.

Finite element (FEM) simulations demonstrate that the bandwidth of a metamaterial substrate, such as the EBG substrate layer 126, is directly proportional to the permeability of the substrate 106 in which the metamaterial is embedded or on which the metamaterial is laid. Additionally, the bandwidth is inversely proportional to the permittivity of the substrate 106. Thus, a high permeability substrate such as a ferrite material can be very advantageous. This is especially true for EBG metamaterial applications, since EBG metamaterials tend to have a narrow band gap region that restricts antenna operation to a narrow band. Embedding the EBG metamaterial 128 in a high permeability textured ferrite substrate 106 can compensate for bandwidth limitations of the EBG metamaterial 128 and effectively expand the bandwidth of the BICA 100. Alternatively, the EBG metamaterial or other metamaterial can be fabricated on top of the ferrite material by patterning metallic films coated directly onto the surface of the ferrite material. In the BICA 100, the textured ferrite substrate 106 can be cobalt substituted Z-type barium hexaferrite (CoZ ferrite). CoZ ferrite can be fabricated according to methods that are well-known in the art, including the ceramic method. CoZ ferrite can function as a high permeability substrate for frequencies from about 10 MHz up to about 4 GHz. Using the design features described herein, the BICA 100 achieves a bandwidth of 70% or greater with the bandwidth defined as the percentage of a radar band.

Certain other features of the circulator 108 also affect the instantaneous bandwidth. In particular, optimal bandwidth can be realized by designing the impedances of the antenna 102 and circulator 108 to be complex conjugates of each other over the frequency range of interest. This can be accomplished during the refinement process and involves refining the antenna 102 and the circulator 108 simultaneously. Additional bandwidth can also be gained from the transmission line type balun transformer 114, which is an integral element in the impedance matching network and is configured to provide balanced input to the antenna, according to aspects of the present invention. When the BICA 100 is in operation, the balun transformer 114 mitigates residual impedance mismatching, allowing the BICA 100 to reach maximum potential bandwidth and assuring efficient power transfer. While the illustrative embodiment includes a transmission line type transformer balun, one of ordinary skill in the art will appreciate that other balun structures can be used depending on the needs and functions of the particular embodiment.

In the illustrative embodiment, the BICA 100 is configured to achieve power efficiency of at least 70%. In addition to increased efficiency from the balun transformer 114 structure, the unique properties of the EBG metamaterial can be manipulated for additional power efficiency. As described supra, there are forbidden frequency bands when operating in the band gap region of the EBG metamaterial. EBG metamaterial can be calibrated and manufactured such that specific undesired frequencies are blocked. Such undesired frequencies may include the frequencies of surface waves or the frequencies associated with other electromagnetic or co-site interference that can cause radiation efficiency degradation. In the EBG metamaterial 128, certain surface waves are blocked, such as waves within the forbidden frequency band.

The illustrative embodiment and variations thereof can be used in a wide range of technology relating to radar applications, as well as wireless and satellite communication applications. Table II shows a list of some example radar applications, their frequency ranges, and their and designations. In addition to those applications listed on the table, possible communications applications include advanced wireless services (including 3G), cable TV relay, cellular and PCS service, UWB, mobile satellite, and space operation and research. One of ordinary skill in the art will appreciate further applications and implementations not specifically mentioned or described in detail herein.

TABLE II

Typical applications across UHF, L-, and S- radar bands

| Band designation | Frequency range | Typical applications |
|---|---|---|
| UHF | 300-1000 MHz | Early warning/surveillance, wind scanners, space research, test range instrumentation, wind profiling |
| L | 1.0-2.0 GHz | Long range surveillance, air traffic control, early warning, synthetic aperture radar, ground battlefield sensors, space-based radar |
| S | 2.0-4.0 GHz | Long range surveillance, air traffic control, marine navigation, weather, air surveillance/tracking, test range instrumentation |

In addition, one of ordinary skill in the art will appreciate that the illustrative antenna described herein can be implemented in various alternative arrangements. For example, the antenna can be used in a phased array or in other arrangements involving numerous antennas mounted and operating together.

One advantage of the illustrative embodiment is that reduced cavity height makes a wider range of performance and manufacturing improvements possible. Specifically, reducing the cavity height allows dramatic reduction in total package height of an antenna module, as exhibited by the BICA 100. In airborne platforms, low total package height of the antenna module can lead to reduced aerodynamic drag. Current commercial and military needs require antenna modules that are suitable for smaller, lighter weight communications/radar technology. This is especially true for Unmanned Autonomous Systems (UAS). Additionally, smaller antennas can have the benefit of being less expensive to manufacture. Lastly, eliminating the need for metallic vias, as in some embodiments of the present invention, can improve, simplify, and reduce the cost of the manufacturing process.

Another advantage of the BICA 100 is that its design mitigates both internal and external interference. The EBG substrate layer 126 blocks other antenna signals operating in the forbidden frequency band as well as surface waves that reduce radiation efficiency. Within the forbidden frequency band, the EBG metamaterial acts as a high impedance surface that prevents other sources of electromagnetic radiation, such as nearby antennas, jammers, and other interferers operating in the forbidden frequency band. Reducing distorting patterns improves radiation efficiency. Situating the antenna 102 on top of the EBG substrate 126 allows the module itself to be placed on any surface without interference or distortion. Reducing interference both improves power efficiency and enhances signal clarity. Furthermore, the BICA 100 operates in an ultra wide bandwidth (>70%) in the UHF, L-, or S-frequency bands. This makes the BICA 100 extremely versatile and applicable to a wide range of technologies.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. An antenna module configured to operate at a center frequency and formed of a plurality of layers, the antenna module comprising:

a first layer having an antenna formed by at least one radiating aperture;

a second layer having a ferrite circulator; and a third layer of reflecting material positioned between the first layer and the second layer, the third layer configured to reflect energy in phase with incident waves;

wherein the first, second, and third layers are positioned substantially parallel to each other in a stack configuration; and wherein the combination of the antenna, reflecting material, and ferrite circulator, form a broadband integrated circulator antenna (BICA) as a single component.

2. The antenna module of claim 1, wherein the antenna and the ferrite circulator are situated less than one quarter of a wavelength at the center frequency away from each other.

3. The antenna module of claim 1, wherein the antenna and the ferrite circulator are situated no more than one twentieth of a wavelength at the center frequency away from each other.

4. The antenna module of claim 1, wherein the antenna and the ferrite circulator are situated about one one-hundredth of a wavelength at the center frequency away from each other.

5. The antenna module of claim 1, wherein the ferrite circulator is a ferrite stripline circulator.

6. The antenna module of claim 1, wherein the reflecting material is a metamaterial selected from the group consisting of electronic bandgap (EBG) metamaterial, a metamaterial comprising a dielectric substrate, or metamaterial comprising a magnetic substrate.

7. The antenna module of claim 1, wherein the reflecting material comprises a high permeability ferrite substrate.

8. The antenna module of claim 1, wherein the reflecting material comprises cobalt substituted Z-type barium hexaferrite.

9. The antenna module of claim 1, wherein the reflecting material comprises a high permeability ferrite substrate having a frequency range of about 10 MHz up to about 4 GHz.

10. The antenna module of claim 1, wherein the value of the input impedances of the circulator and the antenna match and are configured to optimize the bandwidth at operational frequencies.

* * * * *